United States Patent [19]

Matsunaga et al.

[11] 4,376,177

[45] Mar. 8, 1983

[54] SIZING COMPOSITION

[75] Inventors: Kinjiro Matsunaga, Saitama; Kozo Ohira, Funabashi; Yunosuke Nakagawa, Soka, all of Japan

[73] Assignee: Kao Soap Co., Ltd., Tokyo, Japan

[21] Appl. No.: 210,926

[22] Filed: Nov. 28, 1980

[30] Foreign Application Priority Data

Dec. 26, 1979 [JP] Japan ..... 54/170092

[51] Int. Cl.[3] ..... C08L 1/08; C08L 3/04; C08L 99/00

[52] U.S. Cl. ..... 524/35; 524/47; 524/53; 524/68; 524/69; 524/284; 524/315

[58] Field of Search ..... 260/17 A, 17 R, 17.4 ST, 260/17.4 CL, 23 CP, 23 ST, 23 AR, 23 XA, 23 S, 23 H, 23 EM; 106/210, 211, 212, 213; 252/8.6, 8.8; 524/35, 47, 53, 68, 69, 284, 315

[56] References Cited

U.S. PATENT DOCUMENTS

| | | | |
|---|---|---|---|
| 3,001,957 | 9/1961 | Kray et al. | 260/17.4 R |
| 3,060,139 | 10/1962 | Greminger, Jr. et al. | 260/17 A |
| 3,467,647 | 9/1969 | Benninga | 260/17.4 ST |
| 3,954,687 | 5/1976 | Wiest et al. | 260/17 A |
| 4,139,509 | 2/1979 | Matsunaga et al. | 260/17.4 ST |
| 4,226,748 | 10/1980 | Matsunaga et al. | 260/17.4 ST |
| 4,267,090 | 5/1981 | Heimberg et al. | 260/17 A |

*Primary Examiner*—Lorenzo B. Hayes
*Assistant Examiner*—Nathan M. Nutter
*Attorney, Agent, or Firm*—Flynn, Thiel, Boutell & Tanis

[57] ABSTRACT

A fabric sizing composition comprising a copolymer of a vinyl monomer and an unsaturated carboxylic acid copolymerizable therewith, together with a cationic polymer which is added during or after formation of the copolymer.

9 Claims, No Drawings

SIZING COMPOSITION

The present invention relates to a sizing composition. More particularly, the present invention relates to a sizing composition which is effectively adsorbed on various woven fabrics under a high bath ratio condition.

Starch has heretofore been used as a sizing agent, and various improvements have been made for enhancing the properties thereof. Liquid sizing compositions which can be diluted with cold water and used very easily and which are very stable have been developed. For example, these liquid sizing compositions are formed by incorporating a defoaming agent, a mildew-proofing agent, a fluorescent whitening agent, a perfume and other additives into an aqueous solution containing 10 to 15% by weight of carboxymethyl cellulose, starch, polyvinyl alcohol or the like.

However, the starch, polyvinyl alcohol and carboxymethyl cellulose used for these liquid sizing compositions are hard, high-molecular-weight compounds (polymers) having a glass transition temperature higher than 80° C. Although these polymers are inexpensive as sizing agents, when they are used for sizing, the treated cloths become hard and come to have a paper-like feel and touch, and the skin of the wearer of the sized cloth is readily roughened in the portion that contacts the sized cloth. Furthermore, the sized cloth does not have a thick or deep feel or appearance and these sizing agents are not suitable for the treatment of high quality cloths. Moreover, aqueous solutions of these polymers are highly viscous even at low concentrations and they are difficult to handle.

As a sizing composition for overcoming these defects, there has been used an emulsion of polyvinyl acetate. However, because polyvinyl acetate is poor in the property of being adsorbed in cloths, it is necessary to adopt a method in which the emulsion is diluted with a small amount of water and the cloth to which the diluted emulsion is applied is rubbed to cause the polymer to permeate into the cloth, with the result being that non-uniform adhesion of the sizing agent often occurs.

Various attempts have been made to eliminate these defects involved in conventional sizing bases, and recently, a novel sizing composition comprising a sizing base which is cationically charged has been proposed (see, for example, Japanese Patent Laid-Open Specifications Nos. 70191/78, 94688/78 and 53086/77).

As a method of preparing emulsions of cationically charged polymers, that is, cationic polymer emulsions, there is employed a method in which cations are provided by a cationic surface active agent, a cationic vinyl polymer or a cationic monomer, in the presence of a nonionic water-soluble polymer.

These cationic polymer emulsions have a good adsorbability, they can be used in a highly diluted state and the sizing agents can be adhered to cloths uniformly. Accordingly, the defect of non-uniform adhesion can be eliminated. However, these cationic polymer emulsions are poorer in stability than the conventional anionic or nonionic polymer emulsions, or else, a practically sufficient cationic property cannot be imparted to the cloths. Accordingly, when a cationic sizing composition comprising such cationic polymer emulsion is diluted and used for the sizing treatment, the cationic portions are isolated from polymer particles, resulting in a reduction of the cationic property. Therefore, these cationic sizing agents are still insufficient in the sizing capability.

We investigated ways to overcome these defects of the conventional cationic sizing compositions. We discovered that when there is used a cationic sizing base obtained by making present a cationic polymer, which is added during or after copolymerization of a vinyl monomer with an unsaturated carboxylic acid, the cationic characteristic is not reduced by dilution and the adsorbability of the sizing composition to cloths can be improved. Based on this discovery, we have now completed the present invention.

As the vinyl monomer that can be used in the present invention, there can be mentioned vinyl esters of lower fatty acids such as vinyl acetate, vinyl butyrate and vinyl propionate. Among them, vinyl acetate is most preferred. Furthermore, monomers (1) through (7) set forth below, which are copolymerizable with these lower fatty acid vinyl esters, preferably vinyl acetate, can be used in combination with the vinyl ester. The weight ratio of the lower fatty acid vinyl ester to the copolymerizable monomer is from 80/20 to 100/0.

(1) Alkyl esters of acrylic acid and methacrylic acid such as methyl acrylate, methyl methacrylate, ethyl acrylate and ethyl methacrylate.

(2) Diesters of $\alpha,\beta$-ethylenically unsaturated dicarboxylic acids such as dibutyl maleate, diethyl maleate and corresponding fumarates, itaconates and citraconates.

(3) Styrene and ethylene.

(4) Vinyl halides such as vinyl chloride.

(5) Vinylidene halides such as vinylidene chloride.

(6) $\alpha,\beta$-Ethylenically unsaturated carboxylic acid amides and N-alkylol derivatives thereof such as acrylamide and N-methylolacrylamide.

(7) Lower fatty acid vinyl esters different from the one that is the principal ingredient.

Alkyl esters of acrylic acid and methacrylic acid, and ethylene, are preferred as the copolymerizable monomer.

As the unsaturated carboxylic acid that is used in the present invention, there can be mentioned, for example, acrylic acid, methacrylic acid, crotonic acid, maleic acid, fumaric acid, itaconic acid, aconitic acid, sorbic acid, cinnamic acid, $\alpha$-chlorosorbic acid, citraconic acid, p-vinylbenzoic acid, and alkyl half esters, partial esters and partial amides of unsaturated polycarboxylic acids such as itaconic acid, maleic acid and fumaric acid. As the alkyl half ester of the unsaturated polycarboxylic acid, there can be mentioned esters of lower alkyl groups having 1 to 6 carbon atoms, such as monomethyl itaconate, monobutyl itaconate, monomethyl fumarate, monobutyl fumarate and monobutyl maleate. Among these unsaturated carboxylic acids, acrylic acid, methacrylic acid, crotonic acid and maleic acid are preferred.

As the cationic polymer that is made present during or after copolymerization of the vinyl monomer with the unsaturated carboxylic acid in the present invention, there can be mentioned a cationic cellulose or cationic starch (which is preferably water-soluble and rendered cationic by a quaternary ammonium cationic group), or a cationic vinyl polymer or a ring closure polymer of a cationic diallyl compound.

A cationic starch or cationic cellulose represented by the following formula (1) is preferred:

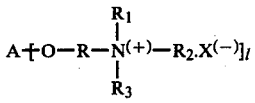

(1)

wherein A stands for a starch or cellulose residue, R stands for an alkylene or hydroxyalkylene group, $R_1$, $R_2$ and $R_3$, which can be the same or different, stand for an alkyl, aryl or aralkyl group, or can form a heterocyclic ring together with the nitrogen atom (N) in the formula, X is an anion such as chlorine, bromine, iodine, sulfuric acid, sulfonic acid, methylsulfuric acid, phosphoric acid or nitric acid, and l is a positive number.

Such cationic starch can be obtained by reacting starch with glycidyl trimethyl ammonium chloride or 3-chloro-2-hydroxypropyl trimethyl ammonium chloride under alkaline conditions. Furthermore, the cationic starch can be obtained by quaternizing dimethylaminoethylated starch. Moreover, the cationic starch can be obtained by reacting starch with 4-chlorobutene trimethyl ammonium chloride. The cationic cellulose can be obtained by subjecting hydroxyethyl cellulose to the above-mentioned reactions.

It is preferred that the degree of substitution in the cationic cellulose or cationic starch be from 0.01 to 1, especially 0.02 to 0.5, of the cationic group introduced per one anhydroglucose unit of the starch or cellulose. If the degree of substitution is lower than 0.01, no substantial effect can be attained. Even if the degree of substitution is higher than 1, no disadvantage is brought about, but from the viewpoint of the reaction yield, it is preferred that the degree of substitution be not higher than 1.

As the cationic vinyl polymer that is used in the present invention, there can be mentioned cationic vinyl polymers represented by the following formulas (2), (3) and (4):

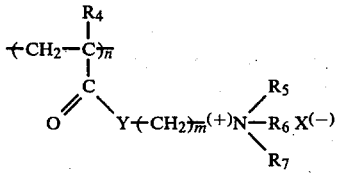

(2)

wherein $R_4$ stands for a hydrogen atom or methyl group, $R_5$, $R_6$ and $R_7$, which can be the same or different, stand for a hydrogen atom, or an alkyl or substituted alkyl group having 1 to 4 carbon atoms, Y stands for an oxygen atom or a group NH in the amide linkage, X is as defined in the formula (1), and m is an integer of from 1 to 10,

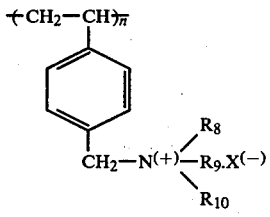

(3)

wherein $R_8$, $R_9$ and $R_{10}$, which can be the same or different, stand for a hydrogen atom or an alkyl or substituted alkyl group having 1 to 2 carbon atoms, and X is as defined in the formula (1),

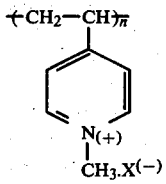

(4)

wherein X is as defined in the formula (1), and poly(N-vinyl-2,3-dimethylimidazolinium chloride) of the following formula (5):

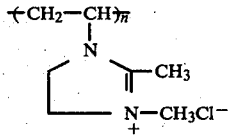

(5)

As the ring closure polymer of the cationic diallyl compound, there can be mentioned those represented by the following formula (6):

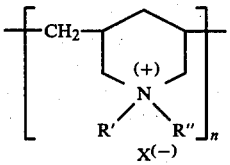

(6)

wherein R′ and R″, which can be the same or different, stand for an alkyl or substituted alkyl group having 1 to 2 carbon atoms, and X stands for an anion such as defined for formula (1).

The viscosity of the aqueous solution of the cationic polymer is 5 to 1,000 cps, preferably 10 to 500 cps, as measured at 20° C. with respect to a 1 wt. % solution.

The relative contents of the foregoing three components in the present invention will now be described. When the vinyl monomer is contained in an amount of 20 to 60% by weight in the aqueous emulsion, in order to make the polymer of this vinyl monomer capable of being satisfactorily adsorbed in a cloth or the like, it is necessary to incorporate 0.01 to 5% by weight, preferably 0.2 to 3% by weight of the cationic polymer, and in order to fix the cationic polymer to the polymer of the vinyl monomer, it is necessary to use 0.1 to 15 parts by weight, preferably 0.2 to 5 parts by weight, based on 100 parts by weight of the vinyl monomer, of the unsaturated carboxylic acid to be copolymerized with the vinyl monomer. Even if the absolute amount of the unsaturated carboxylic acid is increased, the properties of the sizing composition are not degraded, but since the amount of the cationic polymer used becomes large, the use of the unsaturated carboxylic acid in too large an amount is not preferred from the economical viewpoint. If the absolute amount of the unsaturated carboxylic acid is small, fixing of the cationic polymer to the copolymer of the vinyl monomer with the unsaturated carboxylic acid is weak and the intended effect of the present invention is insufficient.

When the sizing composition according to the invention is used for the sizing treatment, if only drying is carried out at normal temperature, a sizing effect comparable to that attained by ironing can be obtained. Furthermore, the sizing composition of the present invention is characterized in that the sizing composition is solubilized or swollen under the alkaline conditions customarily adopted for washing and it can be removed efficiently by washing.

In the present invention, it is indispensable that the cationic polymer should be present during or after copolymerization of the vinyl monomer with the unsaturated carboxylic acid. In the present invention, the additional optional components described below can be made present in appropriate amounts in the copolymerization of the vinyl monomer with the unsaturated carboxylic acid.

A cationic monomer can be used as a particle size distribution adjusting agent for the copolymer. A cationic monomer having at least one nitrogen atom and at least one double bond in the molecule is preferably used. For example, there can be mentioned cationic monomers represented by the following formulae (7) to (10):

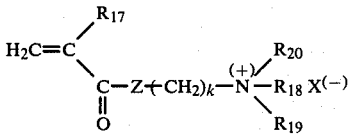

(7)

wherein $R_{17}$ stands for a hydrogen atom or a methyl group, $R_{18}$, $R_{19}$ and $R_{20}$, which can be the same or different, stand for a hydrogen atom or an alkyl or substituted alkyl group having 1 to 22 carbon atoms, X stands for an anion, k is an integer of from 1 to 10, Z stands for an oxygen atom or a group NH in the amide linkage, and $R_{18}$, $R_{19}$ and $R_{20}$, together with the nitrogen atom N, can form a nitrogen-containing ring,

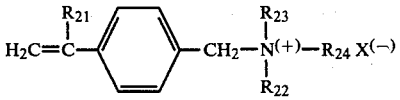

(8)

wherein $R_{21}$ stands for a hydrogen atom or a methyl group, $R_{22}$, $R_{23}$ and $R_{24}$, which can be the same or different, stand for a hydrogen atom or an alkyl or substituted alkyl group having 1 to 2 carbon atoms, and X stands for an anion,

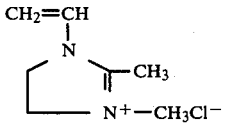

(9)

and

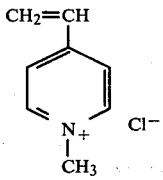

(10)

Among these cationic monomers, there are preferably used vinylbenzyltrimethyl ammonium salts and acrylic or methacrylic acid esters of hydroxyalkyltrialkyl ammonium salts. The cationic monomer is added in an amount of up to 2% by weight, preferably 0.02 to 1% by weight, based on the cationic sizing base emulsion.

A cationic surface active agent can be used as an emulsifier. As the cationic surface active agent, there can be mentioned, for example, alkyltrimethyl ammonium salts, dialkyldimethyl ammonium salts, alkyldimethylethyl ammonium salts, alkyldimethylbenzyl ammonium salts, alkyl pyridinium salts, alkyl quinolinium salts, alkyl isoquinolinium salts, stearylamidomethyl pyridinium salts, acylaminoethylmethyldiethyl ammonium salts, acylaminoethyl pyridinium salts, alkoxymethyl pyridinium salts, 1-methyl-1-acylaminoethyl-2-alkylimidazolines, diacylaminopropyldimethyl ammonium salts, diacylaminoethyldimethyl ammonium salts, dialkyl-di(polyoxyethylene) ammonium salts and dialkylmethylpolyoxyethylene ammonium salts.

An anionic surface active agent can be used as an emulsifier. As the anionic surface active agent, there can be mentioned, for example, higher aliphatic alcohol sulfuric acid salts represented by sodium and potassium salts of sulfuric acid esters of alcohols having 8 to 18 carbon atoms such as lauryl alcohol, sodium, potassium, triethanolamine and other ethanolamine salts of fatty acids having 8 to 18 carbon atoms such as oleic triethanolamide and stearic triethanolamide, sulfonated compounds such as Turkey red oil and sulfated ricinoleic acid, and sulfonated alkylaryl compounds such as sodium t-octylbenzenesulfonate and sodium t-octylphenolsulfonate.

A nonionic surface active agent can be used as an emulsifier according to need. As the nonionic surface active agent, there can be mentioned, for example, alkylphenoxypolyethoxy ethanols having an alkyl group having 7 to 18 carbon atoms and 9 to 30 or more of ethylene oxide units, such as heptylphenoxypolyethoxyethanol, octylphenoxypolyethoxyethanol, methyloctylphenoxypolyethoxyethanol, nonylphenoxypolyethoxyethanol and dodecylphenoxypolyethoxyethanol, alkylphenol polyethoxyethanols linked by methylene bonds, sulfur-containing emulsifiers obtained by condensing nonyl, dodecyl and tetradecyl mercaptans with a necessary amount of an alkylthiophenol having 6 to 15 carbon atoms in the alkyl group, ethylene oxide derivatives of long-chain carboxylic acids such as lauric acid, myristic acid, palmitic acid, oleic acid and Turkey red oil mixed acids, and ethylene oxide derivatives of etherified or esterified polyhydroxyl compounds having a hydrophobic hydrocarbon chain. A nonionic surface active agent having an HLB value of 12 to 19, especially 15 to 18, is preferably used.

In order to obtain an emulsion which is stable for a long time, a nonionic water-soluble polymer can be used. As the nonionic water-soluble polymer, there can be mentioned, for example, polyvinyl alcohol, modified starch and cellulose derivatives. The modified starch that can be used in the present invention is a water-soluble modified starch, for example, hydroxyethylated starch or hydroxypropylated starch. The polyvinyl alcohol that can be used in the present invention is a complete or partial saponification product of a homopolymer of vinyl acetate or a copolymer of vinyl acetate with other comonomer, and a polyvinyl alcohol derivative obtained by modifying such polyvinyl alcohol with an aldehyde or the like. The viscosity of an aqueous solution of such polyvinyl alcohol is 5 to 10,000 cps as measured at a temperature of 30° C. and a polymer concentration of 5%.

A nonionic cellulose derivative, a 5% aqueous solution of which has a viscosity of 5 to 10,000 cps as measured at 30° C., is used in the present invention. For example, there can be mentioned hydroxyethyl cellulose, hydroxypropyl cellulose and methyl cellulose (methylation degree of 10%).

The amount of the nonionic water-soluble polymer is added in an amount of up to 10% by weight, preferably 1.0 to 4.0% by weight, based on the cationic polymer sizing agent base.

As the polymerization initiator that is used for copolymerization in the present invention, 2,2'-azobis(2-amidinopropane) is most preferred. In addition, there can be used hydrogen peroxide, t-butylhydroperoxide, cumene hydroperoxide, t-butyl peroxide, methylethylketone peroxide, cyclohexanone hydroperoxide, peracetic acid and perbenzoic acid. It is preferred that the polymerization initiator be used in an amount of 0.01 to 5.0% by weight, based on the vinyl monomer.

The reaction temperature is 40° to 120° C., preferably 50° to 90° C. The polymerization is carried out at a pH value of 3 to 9, preferably 4 to 8. It is preferred that a buffer agent such as sodium carbonate, sodium bicarbonate, sodium orthophosphate, sodium secondary phosphate, sodium primary phosphate, sodium chloride, sodium sulfate or the like inorganic salt be used in an amount of up to 2% by weight, especially 0.1 to 1% by weight.

Accordingly, it is preferred that a final emulsion of the cationic polymer sizing base of the present invention should have the following contents of the respective ingredients.

| Ingredient | Content |
|---|---|
| Vinyl monomer | 20 to 60% by weight, preferably 25 to 50% by weight |
| Unsaturated carboxylic acid | 0.1 to 15 parts by weight, preferably 0.2 to 5 parts by weight, per 100 parts by weight of the vinyl monomer |
| Cationic polymer | 0.01 to 5% by weight, preferably 0.2 to 3% by weight |
| Cationic monomer | up to 2% by weight, preferably 0.02 to 1% by weight, based on the weight of the emulsion |
| Nonionic, cationic or anionic surface active agent | up to 5% by weight, preferably 0.2 to 2% by weight, based on the weight of the emulsion |
| Water-soluble nonionic polymer | up to 10% by weight, preferably 1 to 4% by weight, based on the weight of the emulsion |
| Polymerization initiator | 0.01 to 5% by weight, preferably 0.02 to 1% by weight, based on the vinyl monomer |
| Inorganic salt | up to 2% by weight, preferably 0.1 to 1% by weight, based on the weight of the emulsion |
| Water | balance |

A preferred sizing composition of the present invention can be formed by performing emulsion polymerization according to the above recipe (the cationic polymer can be added after termination of the emulsion polymerization). All the ingredients can be simultaneously added for the reaction, but there is preferably adopted a method in which the vinyl monomer is gradually added to a reaction vessel charged with all the ingredients, except the vinyl monomer.

The emulsion copolymerization for obtaining the emulsion of the present invention is performed according to a method in which the cationic polymer is made present or is absent (in this latter case, the cationic polymer is added to the copolymerization system after termination of the copolymerization) when the vinyl monomer is copolymerized with the copolymerizable unsaturated carboxylic acid. According to a preferred embodiment of the emulsion copolymerization method, the vinyl monomer other than the cationic monomer is emulsion-polymerized with the unsaturated carboxylic acid in an aqueous solution of the polyvinyl alcohol, nonionic modified starch or nonionic cellulose derivative, in the presence of the cationic starch, cationic cellulose, cationic vinyl polymer or ring closure polymer of the cationic diallyl compound by using a cationic surface agent, an anionic surface active agent, a nonionic surface active agent or a cationic monomer or a mixture of two or more of them.

When the cationic monomer is used for the copolymerization reaction, the effects of adjusting the size of polymer particles, as well as the stabilizing effect and other effects, can be attained according to the amount or structure of the cationic monomer. Furthermore, the cationic polymer, such as the cationic starch, cationic cellulose, cationic vinyl polymer or ring closure polymer of the cationic diallyl compound, exerts a stabilizing effect for polymer particles by acting as a protective colloid, and furthermore, it is adsorbed on the polymer particles so that they are positively charged and exert a function of promoting adsorption of the polymer particles on a cloth negatively charged in water. The cationic surface active agent forms micelles in water at the emulsion polymerization to solubilize the vinyl monomer, impart a polymerization site to the vinyl monomer and improve the dispersion stability of the formed polymer.

The emulsion used for the sizing composition of the present invention can be effectively used as a sizing composition even if it does not contain a water-soluble nonionic polymer such as polyvinyl alcohol, nonionic modified starch or nonionic cellulose derivative. In the present invention, if polyvinyl alcohol, nonionic modified starch or nonionic cellulose derivative is used simultaneously with the cationic vinyl copolymer, the suspension of the vinyl copolymer is further stabilized and the tightness given to a sized cloth is further improved. If the tightness is improved, when a sized white shirt or blouse is ironed, a taut appearance free of wrinkles is given and this effect is very durable. Since the portion of the sized cloth that contacts the skin is softened by the body temperature, the skin is not irritated or damaged by the sizing agent. Furthermore, the sizing agent is not easily dissolved out or stuck in the wet state to the skin by perspiration. The sizing composition is different from an adhesive or binder for which there is required a hard polymer having a high adhesive force or a polymer which can easily be washed away by water.

In addition to the cationic polymer base, the sizing composition of the present invention can comprise additives for ordinary polymer emulsions, for example, plasticizers such as dibutyl phthalate, dibutyl adipate, dioctyl adipate and triacetin, freezing-preventing agents such as ethylene glycol, propylene glycol and ethanol, perfumes, fungicides, antiseptics, fluorescent dyes and pigments.

The sizing composition of the present invention can be used according to the conventional method. A customary bath ratio (the ratio of the aqueous dilution of the sizing composition to a cloth) of from 1/1 to 1/4 can be used, but in the case of the sizing composition of the present invention, good results can be obtained when the bath ratio is adjusted to from 1/10 to 1/100, especially from 1/15 to 1/40. If the bath ratio is thus increased, uniform sizing becomes more easily possible. Furthermore, if the sizing composition is used in households and a strong agitation is continuously given by an electric washing machine to effect the sizing operation while causing the aqueous solution to move vigorously, the sizing agent is well adsorbed in a thick portion of a cloth but adsorption of the sizing agent in a thin portion of the cloth is reduced. Accordingly, the sizing agent is well adsorbed in a thick cloth such as a sheet, and when a white shirt or blouse is treated, adsorption of the sizing agent in a one fabric layer portion, such as the body portion, is smaller than in a double fabric layer portion or core-containing portion, such as a collar or sleeve portion, with the result being that an excellent finishing effect can be obtained as compared with the conventional sizing compositions. Namely, such a finishing effect cannot be attained by the conventional nonionic or anionic sizing agents or the conventional cationic sizing agents free of copolymerized unsaturated carboxylic acids. Increase of the bath ratio or application of an agitation force is of no significance for the conventional non-cationic sizing agents. A mechanical agitation force capable of continuously or discontinuously stirring an aqueous solution of the sizing composition of the present invention is sufficient. For example, when the sizing composition of the present invention is used in households, a conventional pulsator type, agitator type or tumbler type washing machine is conveniently employed.

When the sizing treatment is carried out by using the sizing composition of the present invention, the amount of the effective ingredients, calculated as the solids, of the sizing composition applied to a cloth is 0.2 to 3% by weight, preferably 0.4 to 2% by weight, based on the weight of the cloth.

The present invention will now be described in detail with reference to the following illustrative examples that by no means limit the scope of the invention. In the examples, all references to "parts" mean parts by weight.

EXAMPLE 1

A 5-neck separable flask equipped with a nitrogen-introducing pipe, a stirrer, a monomer metering and dropping device and a reflux cooler was charged with 30 parts of trimethylaminohydroxypropylated starch (which had a nitrogen content of 0.6% and a 1% aqueous solution of which had a viscosity of 40 cps), represented by the following formula:

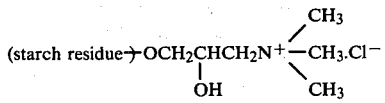

and 550 parts of deionized water, and the mixture was heated at 80° C. to form a solution. After the solution had been cooled to 60° C., 20 parts of vinyl acetate, 0.5 part of 2,2'-azobis(2-amidinopropane)hydrochloride, as the polymerization initiator, and 20 parts of deionized water were added to the solution, and the temperature was elevated to 70° C. to initiate the polymerization. Over a period ranging from 20 minutes from the time of initiation of the polymerization to 300 minutes from the time of initiation of the polymerization, a mixture of x parts of crotonic acid and y parts of vinyl acetate was added dropwise to the solution. After completion of the dropwise addition, the temperature was elevated to 80° C. to complete the reaction.

The results of the sizing test using various cationic polymer sizing bases, formed by changing the ratio of vinyl acetate and crotonic acid, are shown in Table 1. The sizing test was carried out according to the following procedures.

[Sizing Test]

A Terg-O-Meter washing tester was used, and 500 ml of deionized water and 0.4 g, calculated as the solids, of the sizing agent, prepared as described above, were charged in a washing tank (having an internal capacity of 1,000 ml), and after the sizing agent had been sufficiently dispersed, 20 g of a cotton fabric #60 was placed into the washing tank. Agitation was carried out at 100 rpm for 3 minutes. The fabric was dehydrated, air-dried and allowed to stand still in a thermostat chamber maintained at a temperature of 25° C. and a relative humidity of 65%. Then, the sizing effect was evaluated.

Sizing Effect Test Methods (1) Bending Test Method:

The sized cotton fabric was cut into pieces having a size of 2 cm×2.5 cm, and by using 10 cut pieces, the flexural rigidity (g.cm) was measured in a thermostat chamber maintained at a temperature of 25° C. and a relative humidity of 65% by using a bending tester (manufactured by Katto Tekkosho).

(2) Organoleptic Test Method:

In a conventional household washing machine, 20 g of the sizing base, as effective ingredient, was added to 30 l of city service water and the sizing base was sufficiently dispersed. Then, 1,000 g of a cotton sheet was added to the dispersion and agitation was conducted for 3 minutes. The sheet was dehydrated for 30 seconds by a dehydrator and air-dried. The pair comparison test was conducted by 10 persons (a cotton sheet sized by a sizing base free of copolymerized crotonic acid was used as a control) to evaluate the capacity of the sizing base according to the following rankings.

+2: tight and taut compared to control
+1: slightly tight compared to control
0: same as control
−1: slightly less tight compared to control
−2: not tight compared to control The number in Table 1 indicates the number of persons that assigned the indicated rank to the respective compositions.

(3) Easiness of Removal of Size:

The cotton fabric sized and air-dried at the sizing test was iron-pressed at 130° C. for 1 minute and cut into pieces having a weight of 5 g, and the cut pieces were washed at a bath ratio of 1/200 and a rotation rate of 100 rpm for 10 minutes in a Terg-O-Meter type washing tester by using 1,000 ml of deionized water and 1 g of a commercially available detergent, followed by water washing, dehydration, air drying, iron pressing at 130° C. for 1 minute and standing overnight in a thermostat chamber maintained at a temperature of 25° C. and a relative humidity of 65%.

The flexural rigidity was measured by using the above-mentioned bending tester. The easiness (%) of removal of the size was calculated according to the following formula:

$$\text{Easiness (\%) of removal of size} = \frac{b-a}{b} \times 100$$

wherein a stands for the difference between the flexural rigidity after washing (with sizing) and the flexural rigidity after washing (without sizing), and b stands for the difference between the flexural rigidity before washing (with sizing) and the flexural rigidity before washing (without sizing).

TABLE 1

| Run No. | Vinyl Acetate* (parts) | Crotonic Acid (x parts) | Flexural Rigidity (g · cm) Before Ironing | Organoleptic Test +2 | +1 | 0 | −1 | −2 | Easiness of Removal of Size (%) |
|---|---|---|---|---|---|---|---|---|---|
| 1 | 400 | 0 | 0.28 | | | control | | | 30 |
| 2 | 399.7 | 0.3 | 0.28 | | 1 | 7 | 2 | | 49 |
| 3 | 399 | 1 | 0.33 | 1 | 4 | 3 | 2 | | 73 |
| 4 | 396 | 4 | 0.35 | 2 | 4 | 3 | 1 | | 79 |
| 5 | 388 | 12 | 0.36 | 3 | 5 | 2 | | | 94 |
| 6 | 360 | 40 | 0.36 | 2 | 5 | 2 | 1 | | 96 |
| 7 | 320 | 80 | 0.26 | 1 | 1 | 5 | 2 | 1 | 95 |

Note
*the sum of the 20 parts initially added and y parts

EXAMPLE 2

The effects caused by using various unsaturated carboxylic acids were examined.

[Synthesis of Cationic Sizing Base]

In the same reaction vessel as used in Example 1, 5 parts of polyvinyl alcohol (partially saponification product having a saponification degree of 88% and a polymerization degree of 500), 30 parts of trimethylaminohydroxyethylated starch (which had a nitrogen content of 0.6% and a 1% aqueous solution of which had a viscosity of 40 cps) represented by the following formula:

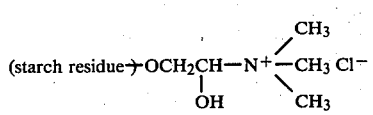

and 500 parts of deionized water were charged, and the temperature was elevated to 80° C. to form a solution. After the solution had been cooled to 60° C., 9 parts of polyoxyethylene (20) lauryl alcohol, 0.3 part of sodium carbonate, 20 parts of vinyl acetate, 0.5 part of 2,2'-azobis(2-amidinopropane)hydrochloride and 80 parts of deionized water were added, and the temperature was elevated to 70° C. to initiate polymerization. Over a period ranging from 20 minutes from the start of the polymerization to 300 minutes from the start of the polymerization, a liquid mixture comprising x parts of an unsaturated monocarboxylic acid, unsaturated polycarboxylic acid or unsaturated polycarboxylic acid half ester, and y parts of vinyl acetate was added dropwise to the reaction mixture. After the dropwise addition, the temperature was elevated to 80° C. to complete the reaction.

The sizing effect of the obtained cationic polymer sizing base was determined in the same manner as described in Example 1. The results shown in Table 2 were obtained.

TABLE 2

| Unsaturated Carboxylic Acid Kind | x Parts | Vinyl Acetate* (parts) | Flexural Rigidity (g · cm) Before Ironing | After ironing |
|---|---|---|---|---|
| Present Invention | | | | |
| acrylic acid | 1 | 399 | 0.32 | 0.46 |
| " | 2.5 | 397.5 | 0.33 | 0.41 |
| " | 6 | 394 | 0.32 | 0.40 |
| crotonic acid | 5 | 395 | 0.36 | 0.41 |
| methacrylic acid | 2 | 398 | 0.32 | 0.41 |
| " | 5 | 395 | 0.33 | 0.42 |
| maleic acid | 0.5 | 399.5 | 0.31 | 0.41 |
| itaconic acid | 0.5 | 399.5 | 0.33 | 0.41 |
| " | 1 | 399 | 0.33 | 0.40 |
| monoethyl maleate | 5 | 395 | 0.33 | 0.42 |
| monoethyl maleate | 10 | 390 | 0.34 | 0.43 |
| Comparison | | | | |
| no unsaturated carboxylic acid added | | | 0.27 | 0.37 |

Note
*the sum of the 20 parts initially added and y parts

EXAMPLE 3

Cationic sizing bases were prepared by using various cationic polymers and vinyl monomers and the properties were examined.

[Synthesis of Cationic Sizing Bases]

In the same reaction vessel as used in Example 1 were placed 7.5 parts of a cationic polymer shown in Table 3, 1.2 parts of polyvinyl alcohol (partial saponification product having a saponification degree of 79% and a polymerization degree of 1600) and 100 parts of deionized water, and the temperature was elevated to 80° C. to form a solution. After the solution had been cooled to 60° C., 10 parts of a vinyl monomer shown in Table 3, 1 part of crotonic acid and, if desired, 2 parts of a nonionic surface active agent, cationic surface active agent or cationic monomer were added. Then, 0.1 part of sodium carbonate, 0.1 part of 2,2'-azobis(2-amidinocyclopropane)hydrochloride or cumene hydroperoxide and 20 parts of deionized water were added and the temperature was elevated to 70° C. to initiate the polymerization. During a period ranging from 20 minutes from the initiation of the polymerization to 300 minutes from the initiation of polymerization, 90 parts of the vinyl monomer was continuously added dropwise to the reaction mixture. After the dropwise addition, the temperature was elevated to 80° C. to complete the polymerization.

COMPARATIVE EXAMPLE 1

A cationic sizing base was reported in the same manner as described in Example 3 except that crotonic acid was not used.

The flexural rigidity before iron-pressing was measured with respect to the sizing bases synthesized in Example 3 and Comparative Example 1, in the same manner as described in Example 1. The results shown in Table 3 were obtained.

-continued

| Sizing Composition: | |
|---|---|
| Dibutyl phthalate | 2 parts |
| Ethanol | 3 parts |
| Propylene glycol | 2 parts |
| Silicone emulsion (30% emulsion of silicone oil having viscosity of 10,000 sentistokes) | 0.5 part |
| Deionized water | 1.5 parts |

TABLE 3

| Run No. | Vinyl Monomer | Cationic Polymer | Cationic Monomer | Surface Active Agent | Flexural Rigidity (g · cm) Present Invention(1) | Flexural Rigidity (g · cm) Comparison(2) |
|---|---|---|---|---|---|---|
| 1 | vinyl acetate | 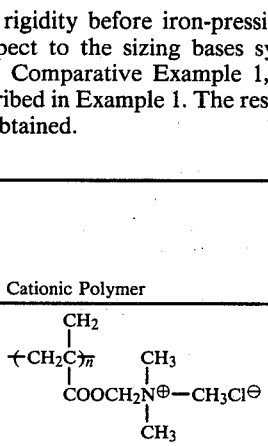 | — | 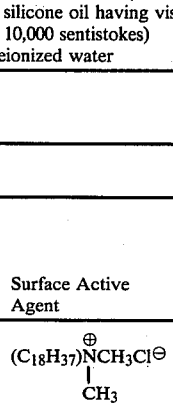 | 0.28 | 0.21 |
| 2 | vinyl acetate | cationic starch (N content = 0.6%) | 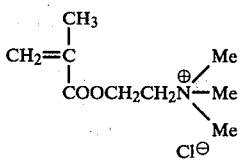 | — | 0.32 | 0.22 |
| 3 | vinyl acetate | cationic cellulose manufactured by Union Carbide Corporation, U.S.A. | — | polyoxyethylene(50) dodecyl ether | 0.25 | 0.19 |
| 4 | vinyl acetate |  | — | polyoxyethylene(35) nonylphenyl ether | 0.27 | 0.22 |
| 5 | vinyl acetate | 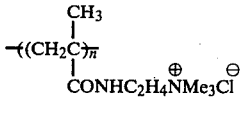 | — | 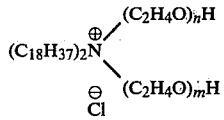 | 0.26 | 0.22 |
| 6 | vinyl acetate | 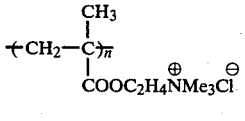 | — | 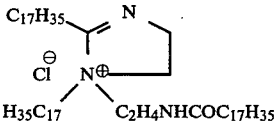 | 0.27 | 0.21 |
| 7 | vinyl propionate | " | — | polyoxyethylene(50) nonylphenyl ether | 0.26 | 0.21 |

Note
(1)According to Example 3 where crotonic acid was used
(2)According to Comparative Example 1 where crotonic acid was not used

EXAMPLE 4

A sizing composition was prepared by using the cationic sizing base synthesized in Example 3 and was subjected to the feel test according to a pair comparison test using a conventional cationic sizing composition as a control.

The obtained results are shown in Table 4.

| Sizing Composition: | |
|---|---|
| Emulsion* | 91 parts |

| Sizing Composition | Emulsion* (cationic sizing base) |
|---|---|
| A (present invention) | sample of Run No. 3 of Example 3 according to present invention |
| B (present invention) | sample having the same composition sample of Run No. 3 of Example 3 except that the cationic polymer was added after polymerization |
| C (control) | sample having the same composition sample of Run No. 3 of Example 3 except that crotonic acid was not added |

Sizing Test

In a conventional household washing machine, the sizing composition in an amount of 6 g, as the effective ingredient, was added to 20 l of city service water and sufficiently dispersed. Then, 500 g of a cotton sheet was added to the dispersion and agitation was conducted for 3 minutes, followed by dehydration for 30 seconds by a dehydrator and air drying.

The tightness of the sized cloth was examined by 10 persons according to the pair comparison feel test method. The evaluation rankings were as follows.

+2: tight and taut compared to control

+1: slightly tighter compared to control

0: same as control

−1: slightly less tight compared to control

−2: not tight compared to control

In the table, the number indicates the number of the persons who assigned the indicated rank to the respective compositions.

TABLE 4

| Sizing Composition Sample | +2 | +1 | 0 | −1 | −2 | Control Sizing Composition Sample |
|---|---|---|---|---|---|---|
| A | 3 | 5 | 2 | | | C |
| B | 1 | 5 | 3 | 1 | | C |

EXAMPLE 5

A stainless steel autoclave cooled below −50° C. was charged with 1.5 parts of a cationic polymer (A) or (B) shown below and 90 parts of a 10% solution of hydroxyethyl cellulose, and 0.5 part of a 20% aqueous solution of hydrogen peroxide and 70 parts of deionized water were added and then, an aqueous solution containing 1 part of polyoxyethylene (50) dodecyl ether, 0.3 part of sodium carbonate and 3 parts of deionized water, 90 parts of vinyl acetate, 2 parts of crotonic acid and 10 parts of ethylene were added. The temperature was elevated, with the autoclave in the sealed state, and emulsion polymerization was carried out at 60° C. for 2 hours and at 80° C. for 1 hour. By using the thus-obtained cationic sizing bases, the sheet sizing test was conducted in the same manner as described in Example 4. In each case, a good tightness was observed.

Cationic Polymer (A):

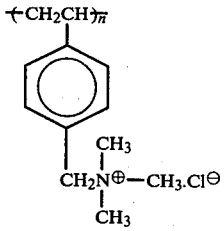

Cationic Polymer (B):

-continued

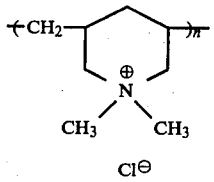

The embodiments of the invention in which an exclusive property or privilege is claimed are defined as follows:

1. A sizing composition comprising an aqueous emulsion prepared by aqueous emulsion copolymerization of a monomer mixture consisting essentially of (A) first vinyl monomer component consisting essentially of (1) from 80 to 100 percent by weight of one or a mixture of two or more vinyl esters of lower fatty acids and (2) from zero to 20 percent by weight of one or more vinyl comonomers copolymerizable with said vinyl ester, with the proviso that said vinyl comonomer does not contain a carboxyl group, and (B) one or a mixture of two or more unsaturated carboxyl group-containing monomers copolymerizable with said first vinyl monomer component, the amount of said unsaturated carboxyl group-containing monomer being in the range of from 0.1 to 15 percent by weight, based on the weight of said first vinyl monomer component; said aqueous emulsion containing admixed therein one or a mixture of two or more cationic polymers having the formula

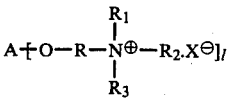

wherein A is a starch or cellulose residue; R is alkylene or hydroxyalkylene; $R_1$, $R_2$ and $R_3$, which are the same or different, are alkyl, aryl or aralkyl, or

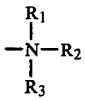

form a heterocyclic ring; X is an anion; and l is a positive number such that the degree of substitution of the cationic group is at least 0.01, per one anhydroglucose unit of the starch or cellulose residue, said cationic polymer being added during the emulsion copolymerization or after the emulsion copolymerization is completed.

2. A sizing composition as set forth in claim 1 which consists essentially of said aqueous emulsion and said cationic polymer, said sizing composition containing from 20 to 60 percent by weight of said first vinyl monomer component and from 0.01 to 5 percent by weight of said cationic polymer.

3. A sizing composition as set forth in claim 1 or claim 2, wherein said unsaturated carboxyl group-containing monomer is a member selected from the group consisting of acrylic acid, methacrylic acid, crotonic acid, maleic acid, fumaric acid, itaconic acid, aconitic acid, sorbic acid, cinnamic acid, α-chlorosorbic acid, citraconic acid and p-vinybenzoic acid.

4. A sizing composition as set forth in claim 1 or 2, wherein the unsaturated carboxyl group-containing monomer is a member selected from acrylic acid, methacrylic acid, crotonic acid and maleic acid.

5. A sizing composition as set forth in claim 1 or claim 2, wherein the unsaturated carboxyl group-containing monomer is an alkyl half ester, partial ester or partial amide of an unsaturated polycarboxylic acid.

6. A fabric sizing composition consisting essentially of an aqueous emulsion of I. copolymer of A. vinyl monomer consisting essentially of from 80 to 100 percent by weight of one or a mixture of two or more vinyl esters of fatty acids having from 1 to 4 carbon atoms and from zero to 20 percent by weight of one or more vinyl comonomers copolymerizable with said vinyl ester, said comonomer being other than an unsaturated carboxyl group-containing monomer, and B. one or a mixture of two or more unsaturated carboxyl group-containing monomers selected from the group consisting of acrylic acid, methacrylic acid, crotonic acid, maleic acid, fumaric acid, itaconic acid, aconitic acid, sorbic acid, p-vinylbenzoic acid, alkyl half esters of unsaturated polycarboxylic acids, partial esters of unsaturated polycarboxylic acids and partial amides of unsaturated polycarboxylic acids, said copolymr containing from 0.2 to 5.0 percent by weight of B, based on the weight of A, said copolymer I being mixed with II. one or a mixture of two or more cationic polymers selected from the group consisting of cationic polymers having the formula

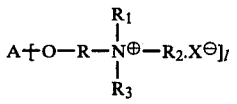

wherein A is starch or cellulose residue, R is alkylene or hydroxyalkylene, $R_1$, $R_2$ and $R_3$, which can be the same or different, are alkyl, aryl or aralkyl, or can form a heterocyclic ring together with the nitrogen atom in the formula, X is an anion selected from the group consisting of chlorine, bromine, iodine, sulfuric acid, sulfonic acid, methylsulfuric acid, phosphoric acid or nitric acid, and l is a number of from 0.01 to 1, per one anhydroglucose unit of A, wherein the viscosity of a 1 wt. percent aqueous solution of said cationic polymer is from 5 to 1,000 cps, measured at 20° C., said emulsion containing from 0.2 to 3.0 percent by weight of said cationic polymer II and from 25 to 50 percent by weight of A, and the balance is essentially water.

7. A fabric sizing composition as claimed in claim 6 containing up to 2% by weight, based on the weight of the emulsion, of cationic monomer effective as a particle size distribution adjusting agent for said copolymer I; up to 5% by weight, based on the weight of the emulsion, of cationic, anionic or nonionic surface active agent effective as an emulsifier for the emulsion; up to 10% by weight, based on the weight of the emulsion, of water-soluble nonionic polymer effective for stabilizing the emulsion; and up to 2% by weight, based on the weight of the emulsion, of an inorganic salt useful to maintain a pH of 3 to 9 during formation of the copolymer.

8. A method of sizing a fabric which comprises immersing the fabric in an aqueous bath containing a composition as claimed in claim 6, wherein the weight ratio of fabric to bath is from 1/10 to 1/100, to deposit on the fabric from 0.2 to 3% by weight of said composition, calculated as the solids, based on the weight of the fabric.

9. A sizing composition as claimed in claim 1, claim 2 or claim 6 in which said vinyl comonomer is selected from the group consisting of alkyl esters of acrylic acid, alkyl esters of methacrylic acid, diesters of $\alpha,\beta$-ethylenically unsaturated dicarboxylic acids, styrene, ethylene, vinyl halides, vinylidene halides, and $\alpha$, $\beta$-ethylenically unsaturated carboxylic acid amides and N-alkylol derivatives thereof.

* * * * *